US008800336B2

(12) United States Patent
Kang et al.

(10) Patent No.: US 8,800,336 B2
(45) Date of Patent: Aug. 12, 2014

(54) APPARATUS AND METHOD FOR FORMING PRODUCT HAVING ASYMMETRIC CROSS-SECTION USING RING ROLLING PROCESS

(75) Inventors: Jong-hoon Kang, Busan (KR); Hyun-jun Kim, Busan (KR); Hong-il Jo, Busan (KR); Young-myung Kim, Gimhae-si (KR)

(73) Assignee: PSM, Inc. (KR)

( * ) Notice: Subject to any disclaimer, the term of this patent is extended or adjusted under 35 U.S.C. 154(b) by 224 days.

(21) Appl. No.: 13/418,578

(22) Filed: Mar. 13, 2012

(65) Prior Publication Data

US 2013/0205856 A1 Aug. 15, 2013

(30) Foreign Application Priority Data

Feb. 13, 2012 (KR) ..... 10-2012-0014433

(51) Int. Cl.
*B21D 22/00* (2006.01)
*B21D 22/16* (2006.01)

(52) U.S. Cl.
USPC ..... 72/107; 72/84

(58) Field of Classification Search
USPC ..... 72/84, 102, 105–110
See application file for complete search history.

(56) References Cited

U.S. PATENT DOCUMENTS

| | | | | | |
|---|---|---|---|---|---|
| 3,230,606 | A | * | 1/1966 | Saito et al. | 72/109 |
| 3,434,322 | A | * | 3/1969 | Cowles et al. | 72/107 |
| 3,681,962 | A | * | 8/1972 | Marcovitch | 72/106 |
| 5,605,068 | A | * | 2/1997 | Yamasoto et al. | 72/105 |
| 5,882,123 | A | * | 3/1999 | Lee et al. | 72/106 |

FOREIGN PATENT DOCUMENTS

| | | | |
|---|---|---|---|
| KR | 10-2006-0066629 | A | 6/2006 |
| KR | 10-0769253 | B1 | 10/2007 |
| KR | 10-2009-0113057 | A | 10/2009 |
| KR | 10-2011-0088175 | A | 8/2011 |
| KR | 10-1188605 | B1 | 10/2012 |

* cited by examiner

*Primary Examiner* — Teresa M Ekiert
(74) *Attorney, Agent, or Firm* — Park & Associates IP Law, P.C.

(57) ABSTRACT

Disclosed herein is an apparatus and method for forming a product having an asymmetric cross-section using a ring rolling process. The method of forming a product having an asymmetric cross-section uses a ring rolling process that uses a ring rolling apparatus, the ring rolling apparatus comprising: a main roll pressing a circumferential outer surface of a blank, a pressure roll pressing a circumferential inner surface of the blank, and a pair of axial rolls pressing upper and lower surfaces of the blank, wherein a protrusion provided on the pressure roll comes into contact with a depressed portion formed on the circumferential inner surface of the blank, and as a width of the blank varies, the pressure roll moves in a vertical direction.

1 Claim, 4 Drawing Sheets

APPARATUS AND METHOD FOR FORMING PRODUCT HAVING ASYMMETRIC CROSS-SECTION USING RING ROLLING PROCESS

FIELD OF THE INVENTION

The present invention relates generally to apparatuses and methods for forming products having asymmetric cross-sections using ring rolling processes and, more particularly, to an apparatus and method for forming a product having an asymmetric cross-section in such a way that a pressure roll is moved in the vertical direction.

BACKGROUND OF THE INVENTION

Generally, a ring rolling process is a process which machines a seamless ring in a continuous manner into a predetermined size, thus producing a product, that is, a rolled ring product. Such ring rolling processes are used to manufacture ring parts used in a variety of fields, for example, power generation equipment, chemical plants, gas turbines, jet engines, etc.

Compared to a ring forging process which is different from a rolling process, advantages of the ring rolling process include that the working speed is rapid, the temperature can be maintained, the production yield can be enhanced, and so on. Particularly, in the case of a rolled ring product that is manufactured by a ring rolling process, the grain flow line is continuously formed in the circumferential direction of the product, thus providing superior characteristics.

FIG. 1 is of views showing an entire ring rolling process. A method of manufacturing a rolled ring product with the ring rolling process will be explained with reference to FIG. 1. At step S1, an initial billet 1 with, for example, a cylindrical structure, is prepared by cutting off a raw billet to an appropriate size using gas cutting or a machine saw.

Subsequently, at step S2, a heating furnace 2 heats the initial billet 1 to the desired temperature. At step S3, the heated initial billet 1 is transferred to a forging press 3.

A mold of the forging press 3 that has been preheated upset-forges the heated initial billet 1, thus pressing the initial billet 1 in the axial direction, at step S4.

Thereafter, at step S5, a punch 4 pierces an intermediate product 1*a* that has been compressed by upset-forging the initial billet 1, thus forming a hollow blank 9.

At step S6, a ring rolling machine subsequently ring-rolls the blank 9. The ring rolling machine includes a main roll 5 which presses a circumferential outer surface of the blank 9, a pressure roll 6 which presses a circumferential inner surface of the blank 9, an upper axial roll 7 which presses an upper surface of the blank 9, a lower axial roll 8 which presses a lower surface of the blank 9, and a plurality of guide rolls 10 which rotatably support the circumferential outer surface of the blank 9. This ring rolling process produces a rolled ring product 11 into a predetermined shape, at step S7.

Particularly, a flange, which is used to connect tubes that form the framework of a wind tower, is typically manufactured by such a ring rolling process. FIG. 2 is a sectional view of a typical flange for wind towers.

As shown in FIG. 2, the flange 10 for wind towers includes a connection part 10*a* that protrudes from the body of the flange 10 and is used when welding a corresponding tube to the flange 10. Producing the flange 10 includes the ring rolling process manufacturing a ring having a rectangular cross-section as illustrated in FIG. 1, and post-processing the ring, thus producing a final product.

Recently, a method is used in which an intermediate product having a depression in a circumferential inner surface thereof is formed, the intermediate product is cut into two parts at a medial portion thereof corresponding to the depression, and then each of the two parts is post-processed, thus forming a final product 10, for example, such as those shown in FIG. 3.

Representative examples of the above conventional technique were proposed in Korean Patent Application No. 10-2009-0131482 (filed on Dec. 28, 2009: Semi-finished ring rolling machine and method of manufacturing semi-finished ring using the same), Patent Application No. 10-2010-0007954 (filed on Jan. 28, 2010: Apparatus and method for manufacturing asymmetric large ring), etc.

However, to form such a product having a depression, a protrusion must be provided on the pressure roll.

In the case of a flange for power towers having an asymmetric cross-section, the material utilization ratio is reduced, and it takes a comparatively long amount of time to carry out a post process. Furthermore, if it is necessary to replace a pressure roll with a pressure roll provided with a protrusion to form an asymmetric cross-section in a blank, it further increases the time it takes to perform the entire machining process.

SUMMARY OF THE INVENTION

Accordingly, the present invention has been made keeping in mind the above problems occurring in the prior art, and an object of the present invention is to provide an apparatus and method for forming a product having an asymmetric cross-section using a ring rolling process in a continuous manner without replacing a pressure roll with another.

In order to accomplish the above object, in an aspect, the present invention provides a method of forming a product having an asymmetric cross-section using a ring rolling process with a ring rolling apparatus, the ring rolling apparatus comprising a main roll pressing a circumferential outer surface of a blank, a pressure roll pressing a circumferential inner surface of the blank, and a pair of axial rolls pressing upper and lower surfaces of the blank, wherein a protrusion provided on the pressure roll comes into contact with a depressed portion formed on the circumferential inner surface of the blank, and as a width of the blank varies, the pressure roll moves in a vertical direction.

Furthermore, a vertical displacement (X) of the pressure roll may be obtained from Equation 3, $$X = H + dT1\left(\frac{w1}{w2}\cdot\frac{d1+2R+w1}{d2+2R+w2}-1\right) \qquad \text{Equation 3}$$

where H denotes a height difference between the blank and a final product, dT1 denotes a height of the depressed portion of the blank, w1 denotes a width of the blank except for the depressed portion, w2 denotes a width of the final product except for the depressed portion, d1 denotes an inner diameter of the blank, d2 denotes an inner diameter of the final product, and R denotes a width of the depressed portion.

In another aspect, the present invention provides an apparatus for forming a product having an asymmetric cross-section using a ring rolling process, including a main roll pressing a circumferential outer surface of a pre-formed blank in a direction perpendicular to a center axis of a hollow space formed in the blank, a pressure roll pressing a circumferential inner surface of the blank, a pair of axial rolls pressing upper and lower surfaces of the blank and limiting a thickness range of the blank, wherein the pressure roll is provided with a protrusion formed on a circumferential outer surface thereof and is movable in a vertical direction.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

Hereinafter, a preferred embodiment of the present invention will be described in detail with reference to the attached drawings.

Figure 3:
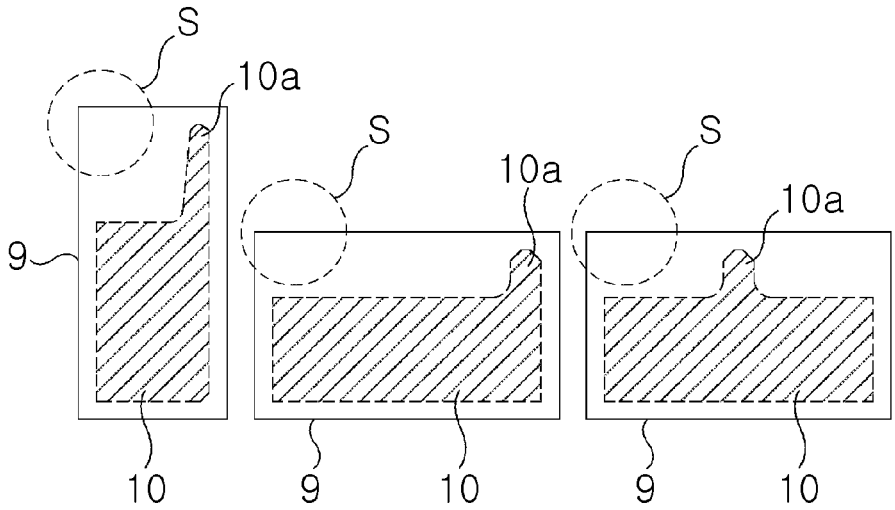
FIG. 3 (Prior Art)
FIG. 3 is of sectional views showing products manufactured by a conventional ring rolling method.
Figure 4:
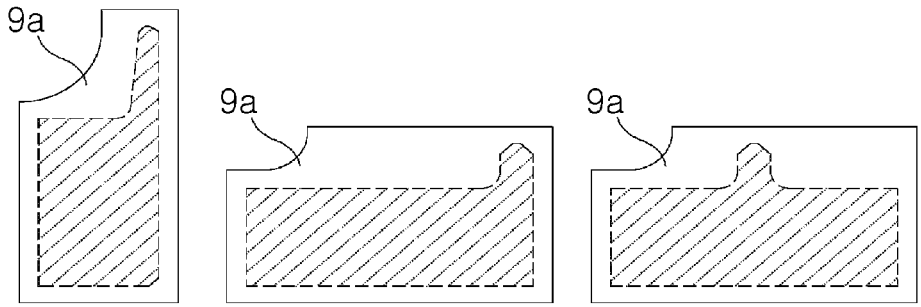
FIG. 4 is of sectional views showing products manufactured by a forming method, according to a preferred embodiment of the present invention.

FIG. 3 is of sectional views showing products manufactured by a conventional ring rolling method. FIG. 4 is of sectional views showing products manufactured by a forming method, according to the preferred embodiment of the present invention.

As shown in FIG. 3, in the case of the conventional technique, if a blank having a rectangular cross-section is machined to form a final product 10 provided with a connection part 10*a* on the upper surface thereof, a comparatively large area of the blank must be machined, as shown in portion S of FIG. 3.

To avoid the above conventional problem, the ring rolling method of the present invention utilizes a depressed portion 9*a* formed in a circumferential inner surface of a blank, as shown in FIG. 4.

In other words, after the depressed portion has been formed in the circumferential inner surface of the blank, the blank is machined by a ring rolling process.

Figure 5:
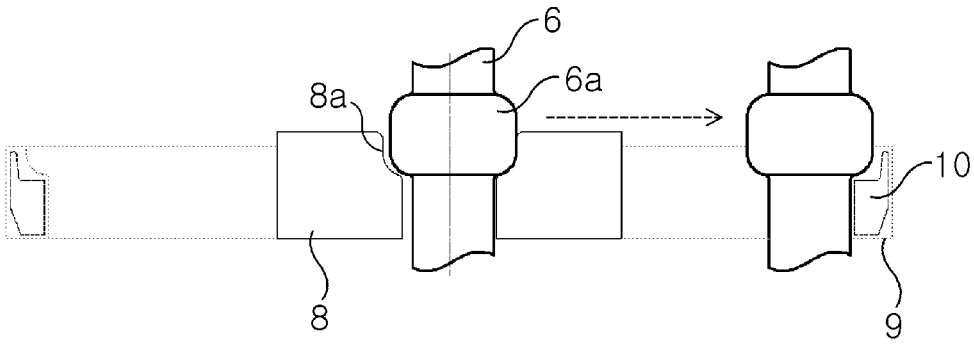
FIG. 5 is a conceptual view illustrating a method of forming a product having an asymmetric cross-section using a ring rolling process according to the preferred embodiment of the present invention.

FIG. 5 is a conceptual view illustrating a method of forming a product having an asymmetric cross-section using the ring rolling process according to the preferred embodiment of the present invention.

Figure 1:
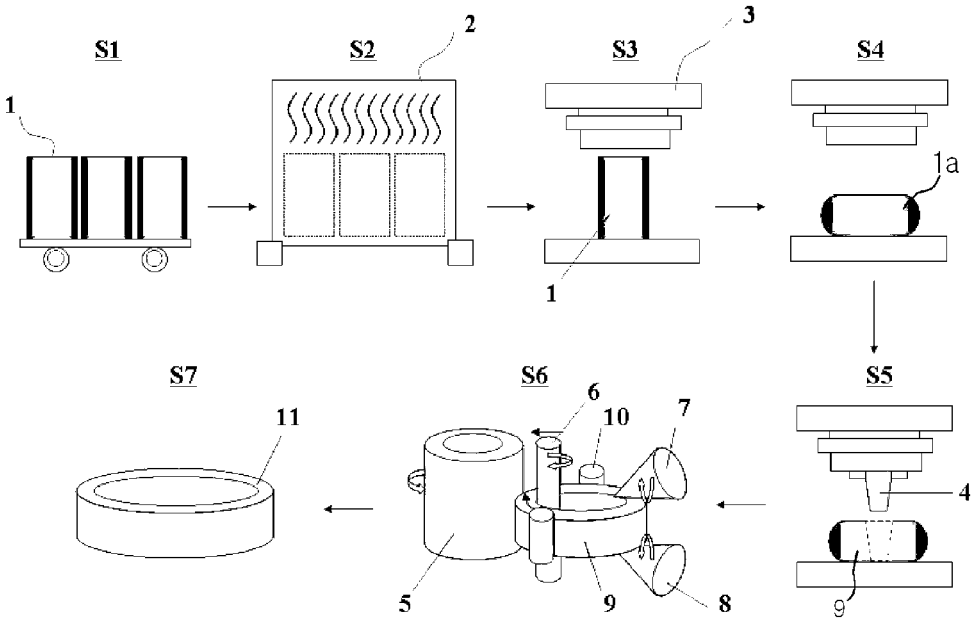
FIG. 1 (Related Art)
FIG. 1 is of views showing a ring rolling process in its entirety.
Figure 2:
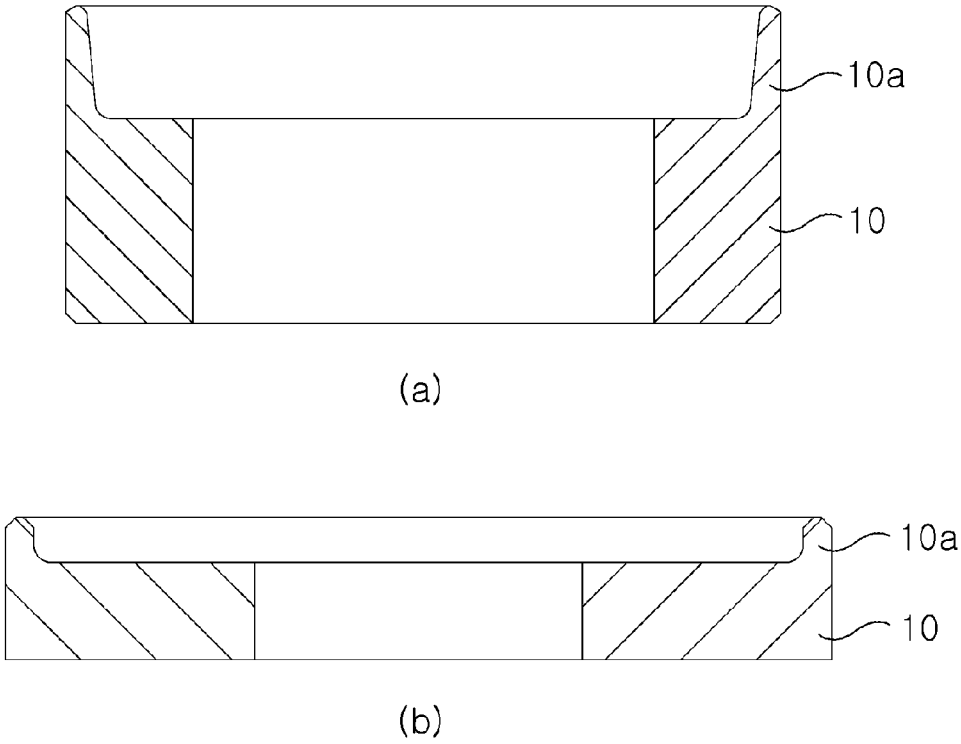
FIG. 2 (Related Art)
FIGS. 2A and 2B are sectional views of final products provided with connection parts.

The method of forming a product having an asymmetric cross-section using the ring rolling process according to the present invention basically makes use of a ring rolling apparatus, in the same manner as does the technique illustrated in FIG. 1, which includes a main roll pressing a circumferential outer surface of the blank, a pressure roll pressing a circumferential inner surface of the blank, and a pair of axial rolls pressing upper and lower surfaces of the blank.

However, unlike the conventional technique, as shown in FIG. 5, the forming method using the ring rolling process according to the present invention is characterized in that a protrusion 6*a* that is provided on the pressure roll 6 comes into contact with a depressed portion 8*a* formed in the circumferential inner surface of the blank 8, and as the width of the blank 8 varies, the pressure roll 6 moves in the vertical direction.

That is, in the typical ring rolling process, the pressure roll 6 rotates and presses the circumferential inner surface of the blank 8 so that the width of the blank 8 is reduced. However, in the present invention, the pressure roll 6 not is only operated in the same manner as that of the conventional technique but is also simultaneously moved in the vertical direction.

To achieve the above purpose, the apparatus for forming a product having an asymmetric cross-section using the ring rolling process according to the present invention basically includes, just as does the conventional forming apparatus: the main roll which presses the circumferential outer surface of the pre-formed blank in a direction perpendicular to the center axis of a hollow space formed in the blank, the pressure roll which presses the circumferential inner surface of the blank, and the pair of axial rolls which press the upper and lower surfaces of the blank and limits a thickness range of the blank. However, unlike the conventional technique, the pressure roll of the present invention is provided with the protrusion provided on the circumferential outer surface thereof and configured such that it can move in the vertical direction.

The structure for moving the pressure roll in the vertical direction can be realized by a hydraulic apparatus, a gear apparatus or the like. Such a hydraulic apparatus or gear apparatus must be able to control the vertical height of the pressure roll under the control of a control unit.

Figure 6:
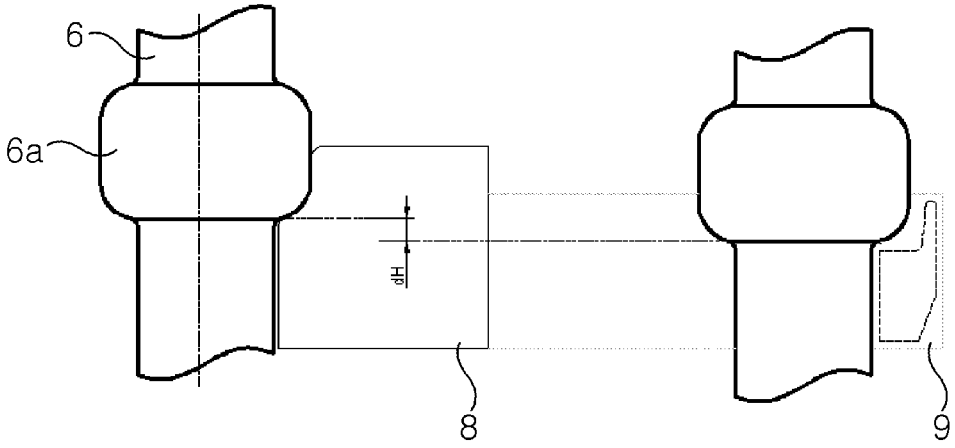
FIG. 6 is a conceptual view showing a direction in which a pressure roll is transferred.

FIG. 6 is a conceptual view showing the direction in which the pressure roll is transferred.

As shown in FIG. 6, when forming a product having an asymmetric cross-section, because the shapes of the blank and a final product are different, not varying the position of the medial line of the pressure roll causes the problem of the volume of some portion of the final product being unbalanced, thus resulting in defects of underfilling or folding.

To avoid the above problems, the pressure roll 6 must be moved by a height dH in the vertical direction.

Figure 7:
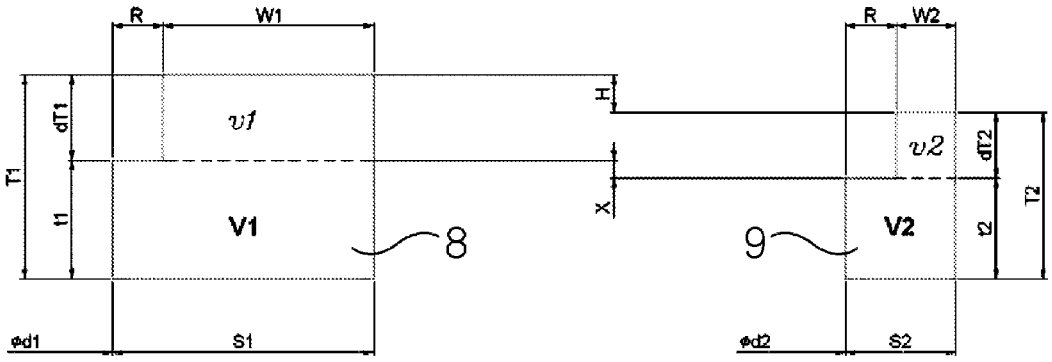
FIG. 7 is a schematic view showing the blank and the final product to determine the position of the medial line of the pressure roll.

FIG. 7 is a schematic view showing the blank and the final product to determine the position of the medial line of the pressure roll.

Referring to FIG. 7, during the process of machining the blank 8 and forming the final product 9, the position of the pressure roll must be controlled to adjust the volume balance between the upper and lower portions of the blank 8.

Given conditions that can minimize surface defects, such as fishtail, folding, etc., which frequently appear on the typical ring milling process, the relationship between the thicknesses and heights of the ring can be expressed by Equation 1.

$$T1^2-S1^2=T2^2-S2^2 \qquad \text{Equation 1}$$

where character T denotes a height of the ring, S denotes a thickness of the ring, suffix numerals 1 and 2 respectively indicate the blank and the final product.

Typically, d1 and d2 are determined by dimensions of the final product and the punch used to pierce the intermediate product produced by forging. Hence, T1 can be obtained from Equation 2 using incompressibility conditions of metal material.

$$\frac{2d2+S2}{2(d1+S1)}=\frac{S1}{S2}\sqrt{1-\left(\frac{S2}{T2}\right)^2+\left(\frac{S1}{T1}\right)^2}$$ Equation 2

Referring to FIG. 7, if the forming process is carried out without moving the pressure roll vertically, when it is H=0 and X=0, it becomes v1>v2 and V1<V2, and as the volume of the blank with respect to the thickness direction varies, a problem of underfilling may occur in the circumferential outer surface of the lower end of the final product.

From Equation 1, H is obtained, and given the law (V1=V2) of volume constancy between the blank and the final production, vertical displacement X of the pressure roll can be obtained from Equation 3.

$$X=H+dT1\left(\frac{w1}{w2}\cdot\frac{d1+2R+w1}{d2+2R+w2}-1\right)$$ Equation 3 where H denotes a height difference between the blank and the final product, dT1 denotes a height of the depressed portion of the blank, w1 denotes a width of the blank except for the depressed portion, w2 denotes a width of the final product except for the depressed portion, d1 denotes an inner diameter of the blank, d2 denotes an inner diameter of the final product, and R denotes a width of the depressed portion.

As described above, in an apparatus and method for forming a product having an asymmetric cross-section using a ring rolling process according to the present invention, the forming process is carried out in such a way that as the width of the blank varies, a pressure roll provided with a protrusion moves in the vertical direction. Therefore, the material utilization ratio can be increased, and the time it takes to perform post-processing can be reduced.

The main technical spirit of the present invention is to provide an apparatus and method for forming a product having an asymmetric cross-section using a ring rolling process. Although the preferred embodiment of the present invention has been disclosed for illustrative purposes, those skilled in the art will appreciate that various modifications, additions and substitutions are possible, and the scope and spirit of the invention must be defined by the accompanying claims.

The invention claimed is:

1. A method of forming a ring product from a blank using a ring rolling apparatus, the method comprising:

providing a blank, said blank having a ring shape with an annular inner wall surface, an annular outer wall surface, an upper surface, and a lower surface;

forming a depressed portion in the annular inner wall surface of the blank;

providing a ring rolling apparatus, said ring rolling apparatus including a main roll for pressing the annular outer wall surface of the blank, a pressure roll for pressing the annular inner wall surface of the blank, the pressure roll having an cylindrical shape with a protrusion with enlarged diameter, and a plurality of axial rolls for pressing the upper and lower surfaces of the blank;

pressing the annular inner wall surface of the blank using the pressure roll and with the protrusion of the pressure roll axially aligned to be in contact with the depressed portion the annular inner wall surface of the blank; and axially displacing the pressure roll to move the protrusion of the pressure roll in the axial direction of the ring shaped blank, said axially displacing the pressure roll being performed during the process of performing said pressing the annular inner wall surface of the blank, wherein an axial displacement (X) of the pressure roll is obtained from the equation of:

$$X=H+dT1\left(\frac{w1}{w2}\cdot\frac{d1+2R+w1}{d2+2R+w2}-1\right)$$

where H denotes a height difference between the blank and a final product, dT1 denotes a height of the depressed portion of the blank, w1 denotes a width of the blank except for the depressed portion, w2 denotes a width of the final product except for the depressed portion, d1 denotes an inner diameter of the blank, d2 denotes an inner diameter of the final product, and R denotes a width of the depressed portion.

* * * * *